US009950235B1

(12) United States Patent
Williams

(10) Patent No.: US 9,950,235 B1
(45) Date of Patent: Apr. 24, 2018

(54) PORTABLE TENNIS PLAYING APPARATUS

(71) Applicant: Albert Williams, Chicago, IL (US)

(72) Inventor: Albert Williams, Chicago, IL (US)

( * ) Notice: Subject to any disclaimer, the term of this patent is extended or adjusted under 35 U.S.C. 154(b) by 0 days.

(21) Appl. No.: 15/332,855

(22) Filed: Oct. 24, 2016

(51) Int. Cl.

| | |
|---|---|
| ***A63B 69/38*** | (2006.01) |
| ***A63B 71/06*** | (2006.01) |
| ***A63B 61/00*** | (2006.01) |
| ***A63B 63/00*** | (2006.01) |

(52) U.S. Cl.
CPC ..... *A63B 69/38* (2013.01); *A63B 61/003* (2013.01); *A63B 63/00* (2013.01); *A63B 71/0622* (2013.01); *A63B 71/0672* (2013.01); *A63B 2071/0625* (2013.01); *A63B 2209/10* (2013.01); *A63B 2210/50* (2013.01)

(58) Field of Classification Search
CPC . A63B 69/38; A63B 69/0073; A63B 69/0097; A63B 61/003; A63B 61/006; A63B 63/00; A63B 71/0622; A63B 71/0672; A63B 2071/0625; A63B 2209/10; A63B 2210/50
See application file for complete search history.

(56) References Cited

U.S. PATENT DOCUMENTS

| | | | | |
|---|---|---|---|---|
| 2,333,098 | A * | 11/1943 | Forsyth | A63B 67/04 473/474 |
| 3,563,544 | A * | 2/1971 | Hedrick | A63B 63/00 473/435 |
| 3,933,355 | A | 1/1976 | Pearce | |
| 4,006,897 | A | 2/1977 | Llorens | |
| 4,021,039 | A | 5/1977 | Hay | |
| 4,037,838 | A | 7/1977 | McCune | |
| 4,053,156 | A | 10/1977 | Bai | |
| 4,240,639 | A | 12/1980 | Bolton et al. | |
| 4,286,785 | A | 9/1981 | Todokoro | |
| 4,309,032 | A * | 1/1982 | Facius | A63B 69/0097 273/376 |
| 4,401,304 | A | 8/1983 | Hamano | |
| 4,852,889 | A * | 8/1989 | Tomczak | A63B 67/002 273/395 |
| 4,949,967 | A | 8/1990 | Todokoro | |
| 4,986,548 | A | 1/1991 | Conner | |
| 5,082,291 | A | 1/1992 | Appel | |
| D352,330 | S | 11/1994 | Smith | |
| 5,375,848 | A | 12/1994 | Coleman | |
| 5,538,253 | A | 7/1996 | Foster | |
| 5,884,911 | A | 3/1999 | Guridi | |
| 5,934,679 | A * | 8/1999 | Strain | A63B 51/04 273/127 C |
| 6,357,750 | B1 * | 3/2002 | Lievens | A63B 69/0097 273/395 |

(Continued)

OTHER PUBLICATIONS

EZ Shot Tennis, EZ Shot Tennis—Practice Like a Pro, www.ezshottennis.com/tennis-training-aids/, accessed Jun. 29, 2016.

(Continued)

*Primary Examiner* — Raleigh W Chiu
(74) *Attorney, Agent, or Firm* — Faegre Baker Daniels LLP

(57) ABSTRACT

A portable tennis playing apparatus allows players to play the game of tennis in various indoor environments. The portable tennis playing apparatus can be assembled and disassembled easily, and provides the opportunity for the players to not only enjoy the game of tennis but also to improve and hone their skills.

20 Claims, 4 Drawing Sheets

(56) References Cited

U.S. PATENT DOCUMENTS 6,991,566 B1* 1/2006 McKinney, Sr. .. A63B 69/0097 473/459
7,468,009 B1* 12/2008 Ball ..... A63B 69/0097 273/396
2005/0049088 A1* 3/2005 Chang ..... A63B 69/0097 473/434
2005/0170916 A1* 8/2005 Morrison ..... A63B 24/0021 473/434
2008/0227571 A1* 9/2008 McTavish ..... A63B 69/0097 473/435
2012/0040781 A1* 2/2012 Edmiston ..... A63B 69/0097 473/422
2012/0149500 A1* 6/2012 Jackson ..... A63B 63/00 473/435
2012/0283046 A1* 11/2012 Yamanashi ..... A63B 63/00 473/432
2013/0130759 A1* 5/2013 Boi ..... A63B 67/002 463/2
2015/0190701 A1* 7/2015 Annapragada ..... A63B 69/0097 473/435
2015/0306483 A1* 10/2015 Dorsett ..... A63B 69/0097 473/435
2016/0175682 A1* 6/2016 Patton ..... A63B 69/38 473/431

OTHER PUBLICATIONS

The Tennis Partner; www.thetennispartner.com; accessed Nov. 21, 2017.

* cited by examiner

PORTABLE TENNIS PLAYING APPARATUS

FIELD OF THE DISCLOSURE

The disclosure relates generally to sports playing equipment, and more particularly, to a portable tennis playing apparatus.

BACKGROUND

The game of tennis is a popular sport that is played by millions of persons around the world. However, tennis is also a game that requires many hours of practice to achieve an appreciable level of proficiency. For many players, finding the right facilities to practice the game can be challenging as, for example, freely available courts are too few and invariably crowded. While some portable tennis courts have been developed, they cannot be easily deployed in indoor environments, such as a home or office, due to, for example, limited space.

Accordingly, what is needed is an apparatus that incorporates sufficient characteristics of a real tennis court, but at the same time, can be conveniently installed in various indoor environments to allow players to learn, practice, and improve their skills at the game of tennis.

SUMMARY

In illustrative embodiments, a portable tennis playing apparatus is disclosed. The apparatus includes a center panel having an outer portion and a detachable center portion. The detachable center portion includes a top surface with line patterns indicative of a real tennis court. The apparatus also includes a first side panel coupled to a first (or left) side of the center panel, and a second side panel coupled to a second (or right) side of the center panel. A net, resembling a tennis net, is located in front of the center panel with a first end of the net being coupled to the first side panel and a second end of the net being coupled to the second side panel. The apparatus further includes an upper panel coupled to the center panel.

The center panel includes an outer portion and a detachable center portion. The outer portion of the center panel may be coupled to the detachable center portion of the center panel with elongated flexible members, such as strings or bungee cords. The top surface of the detachable center portion may include a plurality of targets, which may vary in size and placement positions on the top surface.

To play the game of tennis, a user or player uses a paddle to hit a ball onto one of the plurality of targets. The targets and the ball are made of Velcro material, which can allow the ball to become temporarily attached to the targets. When the ball hits or engages a target, a speaker on the apparatus can play a sound to indicate a positive hit. However, the speaker can also play sounds to emulate an audience at a real tennis court even if the ball does not hit or engages a target. The user or player can also toss Velcro balls to the targets to score points. Players can keep score of the tennis game by manually operating a scoring wheel, or by an automated scoring system. For example, if a player hits a target with a ball, the player can operate a manual scoring wheel to indicate the score. Alternatively, an automated scoring system can sense that the target was hit, and automatically indicate the score, for example, on a display.

A trampoline can also be placed in front of the net to allow the ball to bounce off of the trampoline before being hit by the player. For example, the player can throw the ball at the trampoline to have the ball bounce back to the player for the player to hit towards a target. The apparatus can also be mounted on a wall.

Among other advantages, the portable tennis playing apparatus can be readily assembled for use and disassembled for storage. By having the characteristics of a real tennis court, the portable tennis playing apparatus can motivate users to learn the game and improve their skills, while providing amusement and affording exercise for their bodies. This may be especially useful for beginners of the sport, as well as children, students, seniors, and people with disabilities.

BRIEF DESCRIPTION OF THE DRAWINGS

The embodiments will be more readily understood in view of the following description when accompanied by the below figures and wherein like reference numerals represent like elements.

DETAILED DESCRIPTION OF THE PREFERRED EMBODIMENTS

Figure 1:
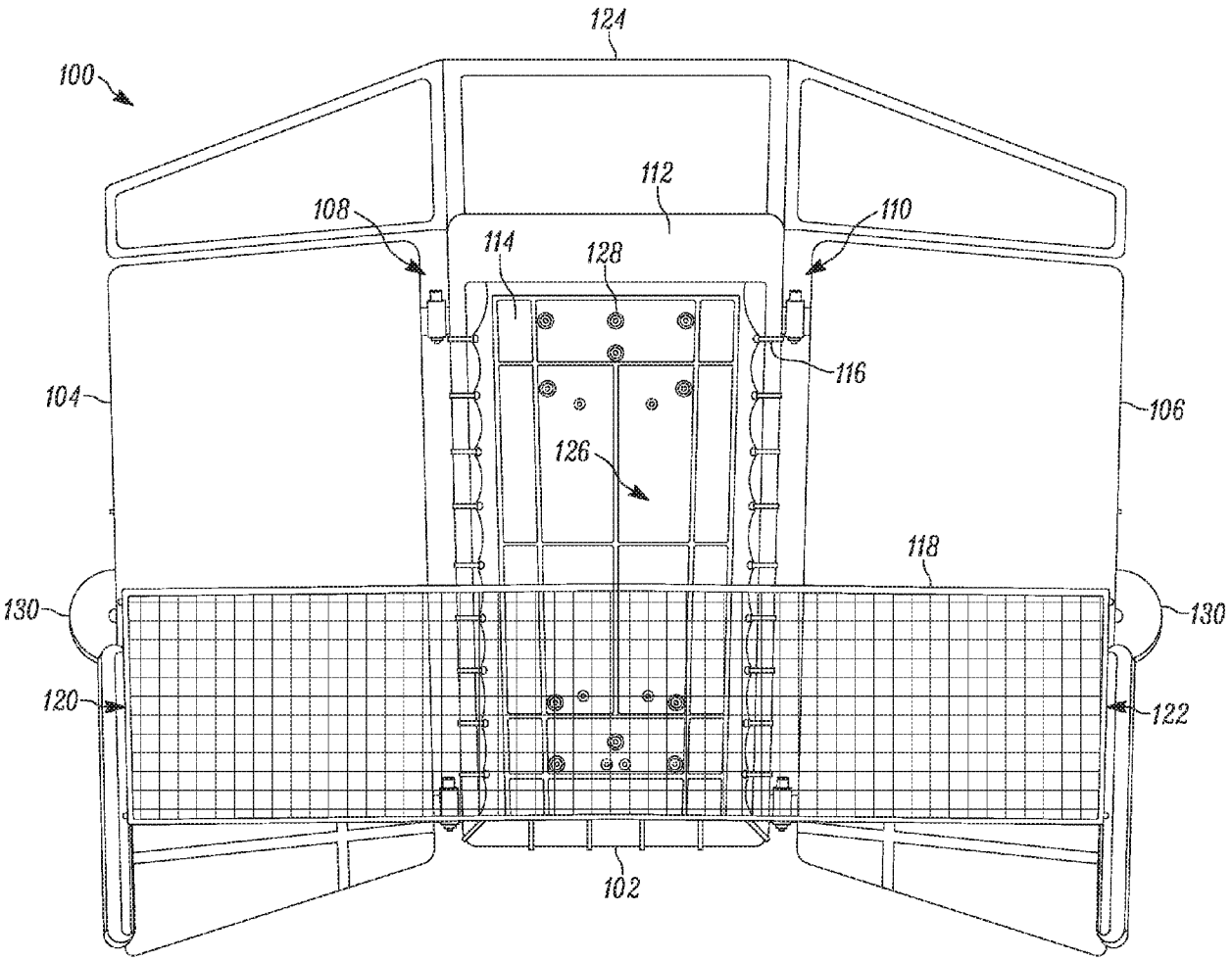
FIG. 1 is a perspective front view of an example of a portable tennis playing apparatus in accordance with one embodiment.

While this invention is susceptible of embodiments in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

FIG. 1 is a perspective front view of an example portable tennis playing apparatus 100. The portable tennis playing apparatus 100 includes a center panel 102, a first side panel 104 and a second side panel 106. The first side panel 104 is coupled to a first side 108 (e.g., left side) of the center panel 102, while the second side panel 106 is coupled to a second side 110 (e.g., right side) of the center panel 102. The first and second side panels 104, 106 may be made of cardboard, plastic, or other suitable material. The first and second side panels 104, 106 may be coupled to the center panel 102 by using, for example, hinges, screws, bolts, or other similar mechanisms.

The center panel 102 includes an outer portion 112 and a detachable center portion 114. The outer portion 112 may be made of the same material as the first and second side panels 104, 106, for example, or from other suitable material. The detachable center portion 114 may be made of felt or another fibrous material. The detachable center portion 114 is coupled to the outer portion 112 by using elongated flexible members 116, such as strings, ropes, cords, bungee straps, etc.

A net 118, that can resemble a real tennis net, is located in front of the center panel 102. As shown in the embodiment of FIG. 1, the net 118 is stretched above ground in front of the center panel 102 with a first end 120 of the net 118 being coupled to the first side panel 104 and a second end 122 of the net 118 being coupled to the second side panel 106. The net 118 may be coupled to the first and second side panels 104, 106 by using various fastening means, such as hooks, eyes, clips, snaps, and the like.

The portable tennis playing apparatus 100 also includes an upper panel 124 that is coupled to the center panel 102. As shown in the embodiment of FIG. 1, the upper panel 124 has a trapezoidal shape and is located on top of the center panel 102, the first side panel 104 and the second side panel 106. The upper panel 124 may be made of the same material as the first and second side panels 104, 106, for example. The upper panel 124 may be coupled to the center panel 102 by using various fastening means, such as hooks, eyes, clips, snaps, and the like. In some embodiments, the upper panel 124 may be coupled to the center panel 102 as well as the first and second side panels 104, 106. The first and second side panels 104, 106 and the upper panel 124 provide structural support for the center panel 102.

The detachable center portion 114 of the center panel 102 has a top surface 126 that may be decorated with line patterns indicative of a tennis court (e.g., baseline, service line, center service line, singles sidelines, doubles sidelines, etc.), or other suitable decorative designs. Further, the first and second side panels 104, 106 are decorated with pictures showing the background of the tennis court (e.g., audiences, benches, flood lights, etc.), or other suitable decorative designs. These decorations can be used, in part, to emulate or show the characteristics of a real life tennis court.

The top surface 126 also includes a plurality of targets 128, which can vary in size and placement positions on the top surface 126. As shown in the embodiment of FIG. 1, the plurality of targets 128 are arranged in a stationary pattern located near the top of the detachable center portion 114. One side of each of the plurality of targets 128 may be permanently affixed to the top surface 126, while the other side may be used to receive another object, such as a ball. In this regard, the other side of each of the plurality of targets 128 may be made of a Velcro material (e.g., the other side may be made of a fabric material with small loops, which can be temporarily attached to another fabric material with tiny hooks until pulled part).

To use the portable tennis playing apparatus 100, at least one ball and a racquet or paddle can be used (not shown). The object of the game is to have a player use a racquet or paddle to hit a ball onto one of the plurality of targets 128. Alternatively or additionally, the player can toss a ball onto one of plurality of targets 128. In any case, the ball may be wrapped in an attachment material (e.g., made of Velcro). This allows the ball to become temporarily attached to at least one of the plurality of targets 128 when the ball is hit onto one of the plurality of targets 128 on the top surface 126 of the detachable center portion 114 of the center panel 102.

If the ball does not hit or engage at least one of the plurality of targets 128 on the detachable center portion 114 of the center panel 102, then the ball will simply bounce back to the player. The ball will also bounce back to the player if the ball is hit anywhere on the first and second side panels 104, 106 or the upper panel 124. In this manner, the first and second side panels 104, 106 and the upper panel 124 can control the ball from bouncing out of bounds from the apparatus 100. Further, the net 118 serves a visual barrier for the player when trying to hit the ball onto the plurality of targets 128.

Players may take turn hitting a ball onto the plurality of targets 128 and keep score similar to a tennis game. A small sized target may be more difficult for a player to hit than a target of larger size. Regardless, to keep score, the players may manually turn or operate scoring wheels 130 located on each side of the first and second side panels 104, 106. In some embodiments, an electronic score keeper may be utilized. For example, when a ball hits one of the plurality of targets 128, the electronic score keeper automatically will record the hit and update the score.

Figure 2:
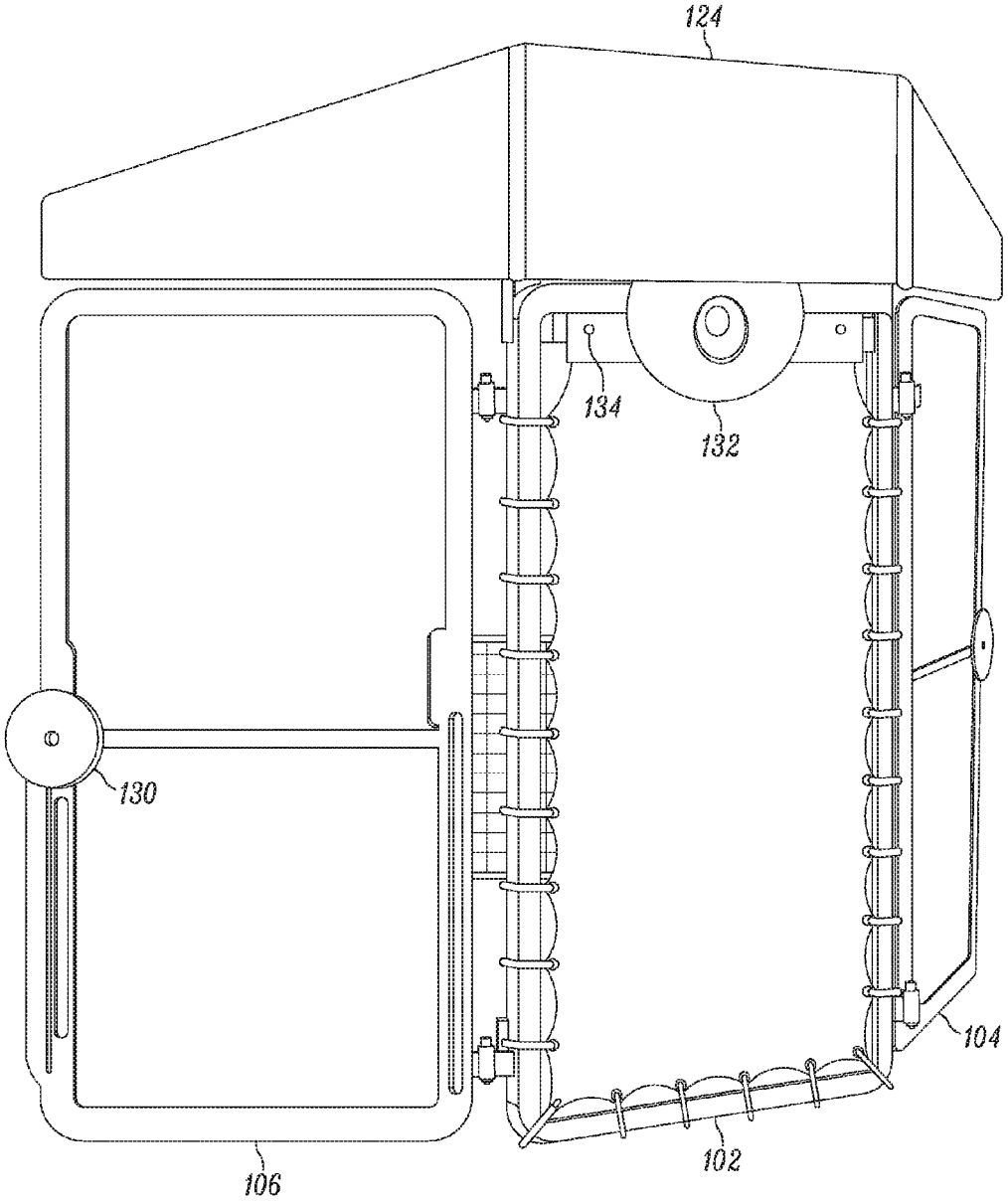
FIG. 2 is a perspective backside view of an example of a portable tennis playing apparatus in accordance with one embodiment.

FIG. 2 is a perspective backside view of the portable tennis playing apparatus 100. As shown in FIG. 2, in addition to the various panels 102, 104, 106 and 124, the portable tennis playing apparatus 100 includes a speaker 132 located on the center panel 102. The speaker 132 is operably coupled to the plurality of targets 128. During game play, whenever a ball engages or hits one of the plurality of targets 128, the speaker will play a sound. For example, the speaker 132 may play a clapping sound to indicate approval of the player for having hit the ball on a target 128. However, when the ball does not hit any of the plurality of targets 128, the speaker 132 can also play one or more sounds to emulate an audience or atmosphere at a tennis court. For example, the speaker 132 may play an announcement declaring that the game will continue or play various cheering sounds from the audience to encourage the player.

Moreover, the portable tennis playing apparatus 100 may include support means 134 (e.g., hooks) for mounting the apparatus 100 to a wall. This wall-mounted setup gives the portable tennis playing apparatus 100 even more space saving features.

Figure 3:
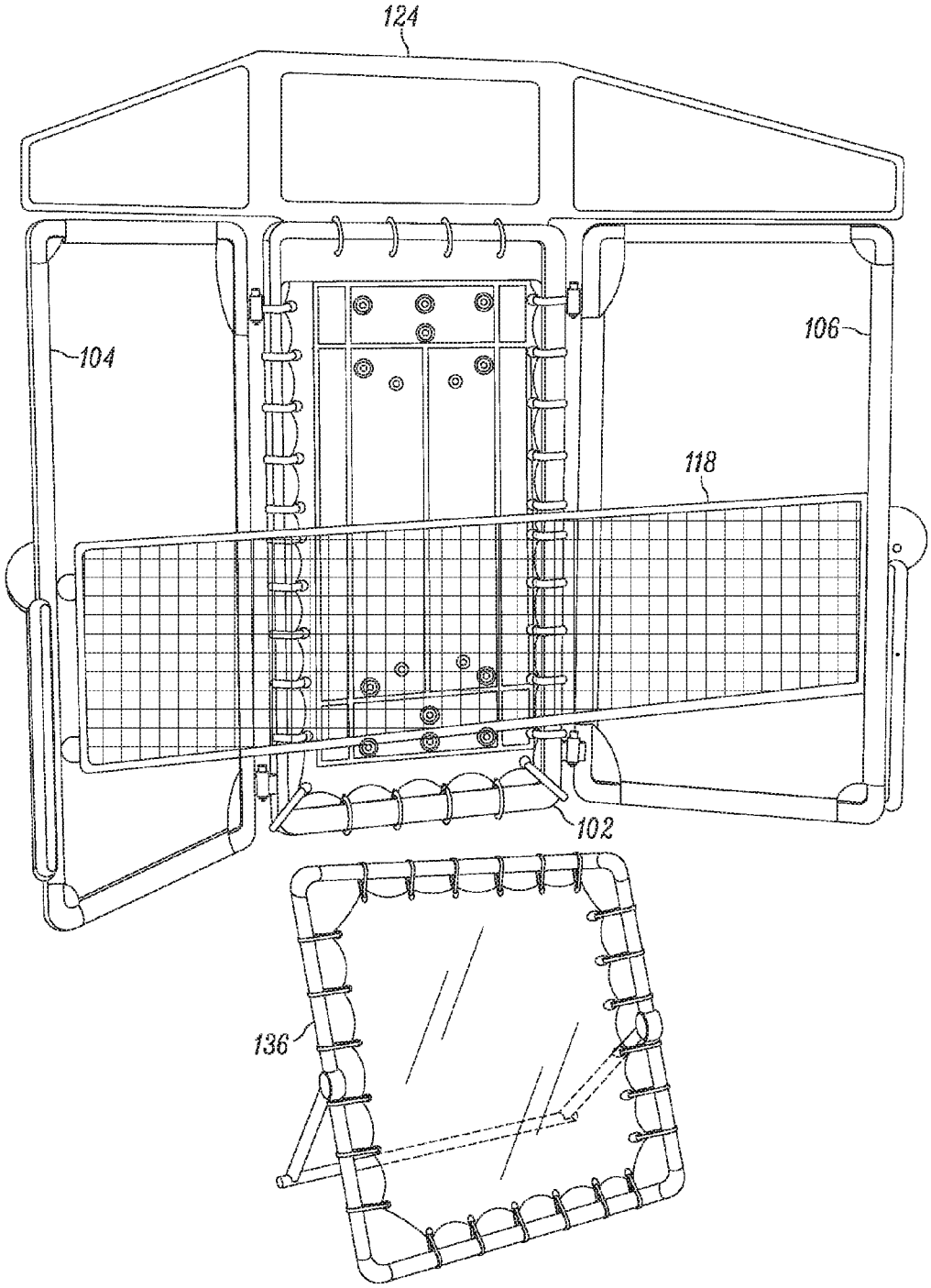
FIG. 3 is a perspective front view of another example of a portable tennis playing apparatus in accordance with one embodiment.

FIG. 3 is a perspective front view of another example of the portable tennis playing apparatus 100. As shown in FIG. 3, in addition to the various panels 102, 104, 106, 124 and the net 118, the portable tennis playing apparatus 100 includes a trampoline 136 located in front of the net 118. The trampoline 136 is set up or aligned to allow a ball, thrown by a player, to bounce off of the trampoline 136 before the player can hit the ball toward the plurality of targets 128 on the top surface 126 of the detachable center portion 114 of the center panel 102. As illustrated, the trampoline can include an outer portion and a detachable center portion. The outer portion of the trampoline can be coupled to the detachable center portion of the trampoline with elongated flexible members, such as strings or bungee cords, for example.

Figure 4:
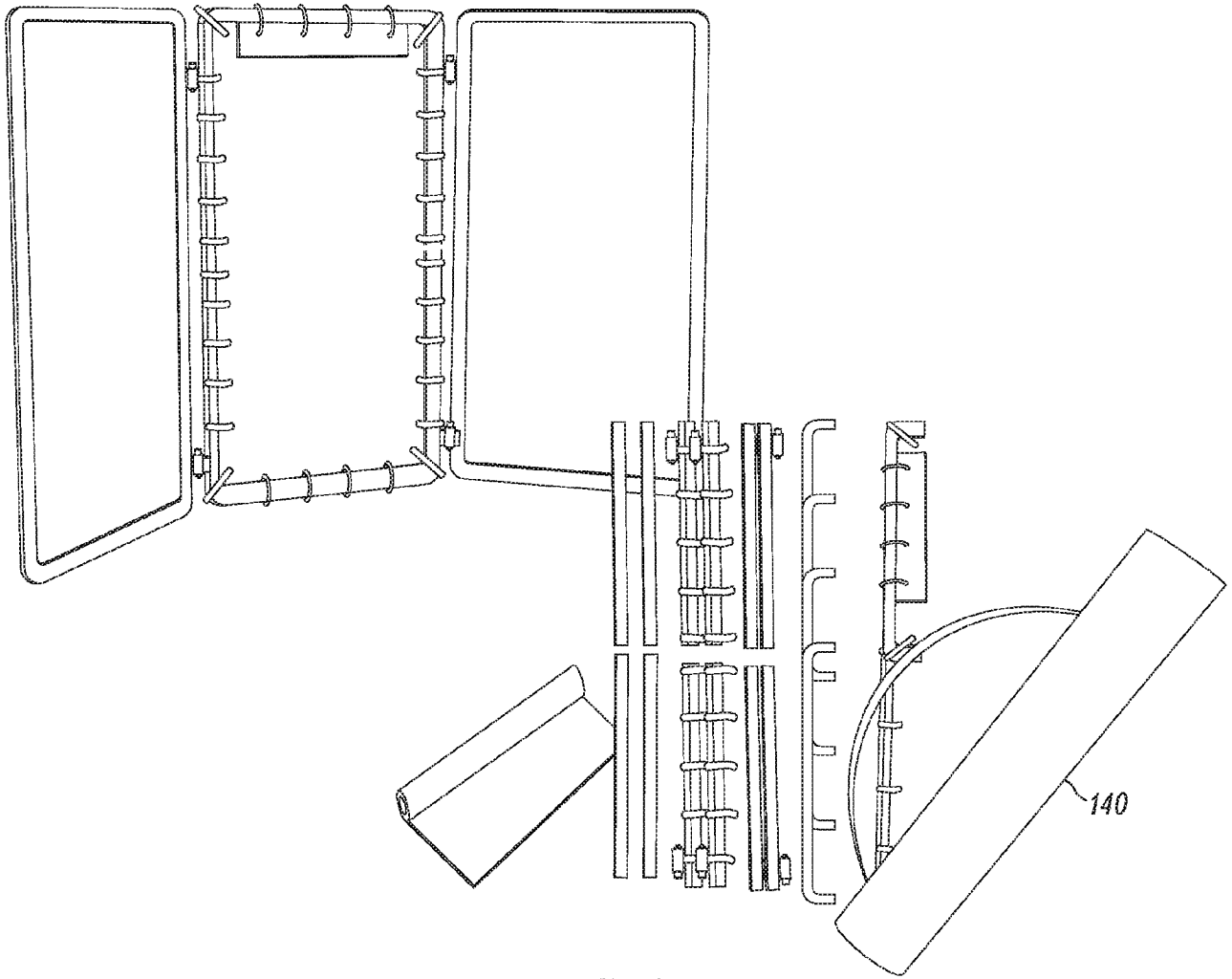
FIG. 4 is a perspective view of an example of a disassembled portable tennis playing apparatus in accordance with one embodiment.

FIG. 4 is a perspective view of the portable tennis playing apparatus 100 in a disassembled state. In the embodiment shown in FIG. 4, each of the panels 102, 104, 106, 124 plus the net 118 can be taken apart and rolled up to be transported in an easy to carry travel tube 140.

The portable tennis playing apparatus described in the embodiments above allow individuals to play the game of tennis in various indoor environments. By allowing players to practice on their short shots, the apparatus can offer the opportunity for the players to improve on their long shots. The apparatus may be used by anyone desiring to have fun while striving to enhance their tennis playing skills.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An apparatus comprising:

a center panel comprising an outer portion and a detachable center portion, wherein the detachable center portion comprises a top surface with line patterns indicative of a tennis court;

a first side panel coupled to a first side of the center panel;

a second side panel coupled to a second side of the center panel; and a net located in front of the center panel, with a first end of the net coupled to the first side panel and a second end of the net coupled to the second side panel.

2. The apparatus of claim 1, further comprising an upper panel coupled to the center panel.

3. The apparatus of claim 1, wherein the outer portion of the center panel is coupled to the detachable center portion of the center panel with elongated flexible members.

4. The apparatus of claim 3, wherein the top surface of the detachable center portion of the center panel includes a plurality of targets.

5. The apparatus of claim 4, wherein the center panel includes a speaker operably coupled to the plurality of targets, wherein the speaker is operable to play a sound when any one of the plurality of targets are engaged.

6. The apparatus of claim 4, wherein the plurality of targets vary in size and position placed on the top surface.

7. The apparatus of claim 5, wherein the speaker plays sounds to emulate an audience at the tennis court.

8. The apparatus of claim 1, wherein each of the first side panel and the second side panel includes a scoring wheel.

9. An apparatus comprising:

a center panel comprising an outer portion and a detachable center portion, wherein the detachable center portion comprises a top surface with line patterns indicative of a tennis court;

a first side panel coupled to a first side of the center panel;

a second side panel coupled to a second side of the center panel;

a net located in front of the center panel, with a first end of the net coupled to the first side panel and a second end of the net coupled to the second side panel; and a trampoline placed in front of the net.

10. The apparatus of claim 9, further comprising an upper panel coupled to the center panel.

11. The apparatus of claim 9, wherein the outer portion of the center panel is coupled to the detachable center portion of the center panel with elongated flexible members.

12. The apparatus of claim 11, wherein the top surface of the detachable center portion of the center panel includes a plurality of targets.

13. The apparatus of claim 12, wherein the center panel includes a speaker operably coupled to the plurality of targets, wherein the speaker is operable to play a sound when any one of the plurality of targets are engaged.

14. The apparatus of claim 9, wherein each of the first side panel and the second side panel includes a scoring wheel.

15. A tennis game set comprising:

an apparatus with a center panel coupled to a first side panel and a second side panel, and a net located in front of the center panel, the center panel comprising an outer portion and a detachable center portion, wherein the detachable center portion comprises a top surface with line patterns indicative of a tennis court, wherein the net is coupled to the first side panel at a first end of the net and coupled to the second side panel at a second end of the net;

a ball with an attachment material which becomes attached to the top surface of the center panel when the ball is hit onto the top surface of the detachable center portion of the center panel; and a paddle operable to hit the ball onto the top surface of the detachable center portion of the center panel.

16. The tennis game set of claim 15, wherein the top surface of the detachable center portion of the center panel includes a plurality of targets wherein the ball becomes attached to at least one of the plurality of targets when the ball hits the at least one of the plurality of targets.

17. The tennis game set of claim 15, further comprising a trampoline located in front of the net, wherein the trampoline is aligned to allow the ball to bounce off of the trampoline before being hit by the paddle onto the top surface of the detachable center portion.

18. The tennis game set of claim 16, wherein the center panel includes a speaker operably coupled to the plurality of targets, wherein the speaker is operable to play a sound when any one of the plurality of targets are engaged, and wherein the speaker is operable to play sounds emulating an audience at the tennis court.

19. The tennis game set of claim 15, further comprising a support means to mount the apparatus to a wall.

20. The tennis game set of claim 15, wherein the attachment material is made of Velcro.

* * * * *